US007048154B2

(12) United States Patent
Phillips et al.

(10) Patent No.: US 7,048,154 B2
(45) Date of Patent: May 23, 2006

(54) BREATHABLE RUPTURABLE CLOSURE FOR A FLEXIBLE CONTAINER

(76) Inventors: Edward W. Phillips, 8467 Colony Dr., Algonac, MI (US) 48001; William E. Phillips, 999 Panoramic Way, Oakland, CA (US) 94704

( * ) Notice: Subject to any disclaimer, the term of this patent is extended or adjusted under 35 U.S.C. 154(b) by 0 days.

(21) Appl. No.: 10/804,986

(22) Filed: Mar. 20, 2004

(65) Prior Publication Data

US 2005/0205610 A1 Sep. 22, 2005

(51) Int. Cl.
*B65D 37/00* (2006.01)

(52) U.S. Cl. ..... 222/212; 222/214; 222/491; 222/494; 222/541.3; 215/260

(58) Field of Classification Search ..... 222/212, 222/214, 490–496, 215, 482, 481, 541.3, 222/541.4, 541.6; 215/253, 260, 344, 350
See application file for complete search history.

(56) References Cited

U.S. PATENT DOCUMENTS

| | | | | | |
|---|---|---|---|---|---|
| 3,241,726 | A | * | 3/1966 | Chester | 222/211 |
| 3,698,598 | A | * | 10/1972 | Wood et al. | 220/89.2 |
| 4,133,457 | A | * | 1/1979 | Klassen | 222/212 |
| 4,331,254 | A | * | 5/1982 | Haggerty | 220/229 |
| 4,356,935 | A | * | 11/1982 | Kamin | 222/1 |
| 4,696,328 | A | | 9/1987 | Rhodes | |
| 4,728,006 | A | * | 3/1988 | Drobish et al. | 222/181.3 |
| 4,938,390 | A | | 7/1990 | Markva | |
| 4,949,857 | A | | 8/1990 | Russell | |
| 5,071,017 | A | * | 12/1991 | Stull | 215/260 |
| 5,353,968 | A | * | 10/1994 | Good, Jr. | 222/212 |
| 5,409,144 | A | * | 4/1995 | Brown | 222/185.1 |
| 5,439,143 | A | * | 8/1995 | Brown et al. | 222/185.1 |
| 5,634,504 | A | | 6/1997 | Chandler | |
| 6,379,069 | B1 | | 4/2002 | May | |
| 6,457,613 | B1 | | 10/2002 | Patterson | |
| 6,659,308 | B1 | | 12/2003 | Kelder et al. | |

* cited by examiner

*Primary Examiner*—Frederick Nicolas

(57) ABSTRACT

A rupturable closure for use with a flexible container that is especially suited for pouring viscous fluids such as motor oil. The closure is secured to the pouring spout or other dispensing opening of the container and retains the viscous fluid in the container as the container is brought into inverted position for pouring. Notwithstanding the ability of the closure to hold in the viscous fluid, the closure also allows the closure to breathe when the cap is removed so as to relieve small variations in pressure as the flexible container is first grasped for pouring and thereby prevent premature rupture of the closure before or as the container is inverted for pouring. Such a closure includes a membrane secured over the dispensing opening of the container. The membrane has a small primary vent orifice in the region over the dispensing opening that is sized to permit the membrane to breathe. The membrane also has three or more part lines terminating in the primary vent orifice along which the membrane parts when the flexible bottle is squeezed. The part lines extend outward from the vent orifice substantially to the periphery of the dispensing opening. Each of the part lines is interrupted by a small connecting element across the line proximate to the primary vent orifice. The primary vent orifice and the connecting elements are of a size, and the connecting elements are positioned sufficiently close to the primary vent orifice, such that the membrane will contain the viscous fluid within the container when the container is brought into inverted position for pouring, yet the connecting elements will break away and the membrane will separate along the part lines when the flexible container is squeezed, thereby enabling the viscous fluid to flow through the dispensing opening.

11 Claims, 3 Drawing Sheets

BREATHABLE RUPTURABLE CLOSURE FOR A FLEXIBLE CONTAINER

BACKGROUND OF THE INVENTION

The present invention relates to containers for pourable viscous fluids such as motor oil and is more particularly directed to a form of closure or seal for the pouring spout of such containers.

Automotive motor oil is commonly sold in individual bottle-like containers formed of a flexible plastic material. Oil is added to the engine by pouring it directly from the container typically one quart at a time into the engine's oil fill tube. It is common to spill a bit of oil on the engine as the container is tipped to bring the pouring spout to the oil fill tube. The spilled oil is unsightly, can leave a messy residue on the engine, and can burn off of hot engine surfaces giving off an undesirable odor as it burns.

A common way of dealing with the spillage problem is to use a wide-mouth funnel to catch the initial spurt of oil as the container is tipped. Another approach especially adapted to the flexible plastic bottle-like container is to provide a closure over the pouring spout of the container that initially supports the weight of the oil as the container is tilted to bring its pouring spout into position over the oil fill tube, but that ruptures when the container is squeezed to let the oil pour out. Such an approach is taken for example in the following US patents: U.S. Pat. No. 4,696,328 of Rhodes, Jr.; U.S. Pat. No. 4,938,390 of Markva, U.S. Pat. No. 5,353,968 of Good, Jr., and U.S. Pat. No. 6,457,613 of Patterson. This type of prior-art approach may be subject to one or more of the following deficiencies. The ruptured closure may restrict the flow of oil to substantially less than that allowed by the full size of the dispensing opening. The pressure required to initiate the rupture of the closure may be sufficiently great as to cause the oil to spurt uncontrollably as the closure is ruptured or may be sufficiently little as to allow premature rupture of the closure for example while grasping the container to remove the cap. Once ruptured, the closure may cause the flow to be uneven and irregular. Pieces of the closure material may dislodge and be carried into the engine along with the oil.

SUMMARY OF THE INVENTION

The present invention provides a rupturable closure for use with a flexible container that is especially suited for pouring viscous fluids such as motor oil. The closure is secured to the pouring spout or other dispensing opening of the container and retains the viscous fluid in the container as the container is brought into inverted position for pouring. Notwithstanding the ability of the closure to hold in the viscous fluid, the closure also allows the closure to breathe when the cap is removed so as to relieve small variations in pressure as the flexible container is first grasped for pouring and thereby prevent premature rupture of the closure before or as the container is inverted for pouring.

Briefly, a closure according to the invention includes a membrane secured over the dispensing opening of the container. The membrane has a small primary vent orifice in the region over the dispensing opening that is sized to permit the membrane to breathe. The membrane also has a number of part lines along which the membrane parts when the flexible bottle is squeezed. In particular, the membrane has at least three part lines that are spaced about the primary vent orifice and that extend all the way to the primary vent orifice.

The part lines extend outward from the vent orifice substantially to the periphery of the dispensing opening. Each of the part lines is interrupted by a small connecting element across the line proximate to the primary vent orifice. The primary vent orifice and the connecting elements are of a size, and the connecting elements are positioned sufficiently close to the primary vent orifice, such that the membrane will contain the viscous fluid within the container when the container is brought into inverted position for pouring, yet the connecting elements will break away and the membrane will separate along the part lines when the flexible container is squeezed, thereby enabling the viscous fluid to flow through the dispensing opening.

It is an object of the invention to provide a closure that opens smoothly starting from the primary vent hole and its immediate vicinity and extending outward toward the periphery when the container is squeezed.

It is another object of the invention to provide a closure that will rupture substantially completely when the container is squeezed.

It is another object of the invention to provide a closure that allows the unruptured closure to breathe so that the closure will not rupture prematurely when the user grasps the container to remove the cap or merely moves it into inverted position in preparation for pouring.

It is yet another object of the invention in at least some of its embodiments to provide a closure that, once ruptured, opens almost to the full effective size of the container's dispensing opening so as to allow effectively full flow through the opening.

Other objects, aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
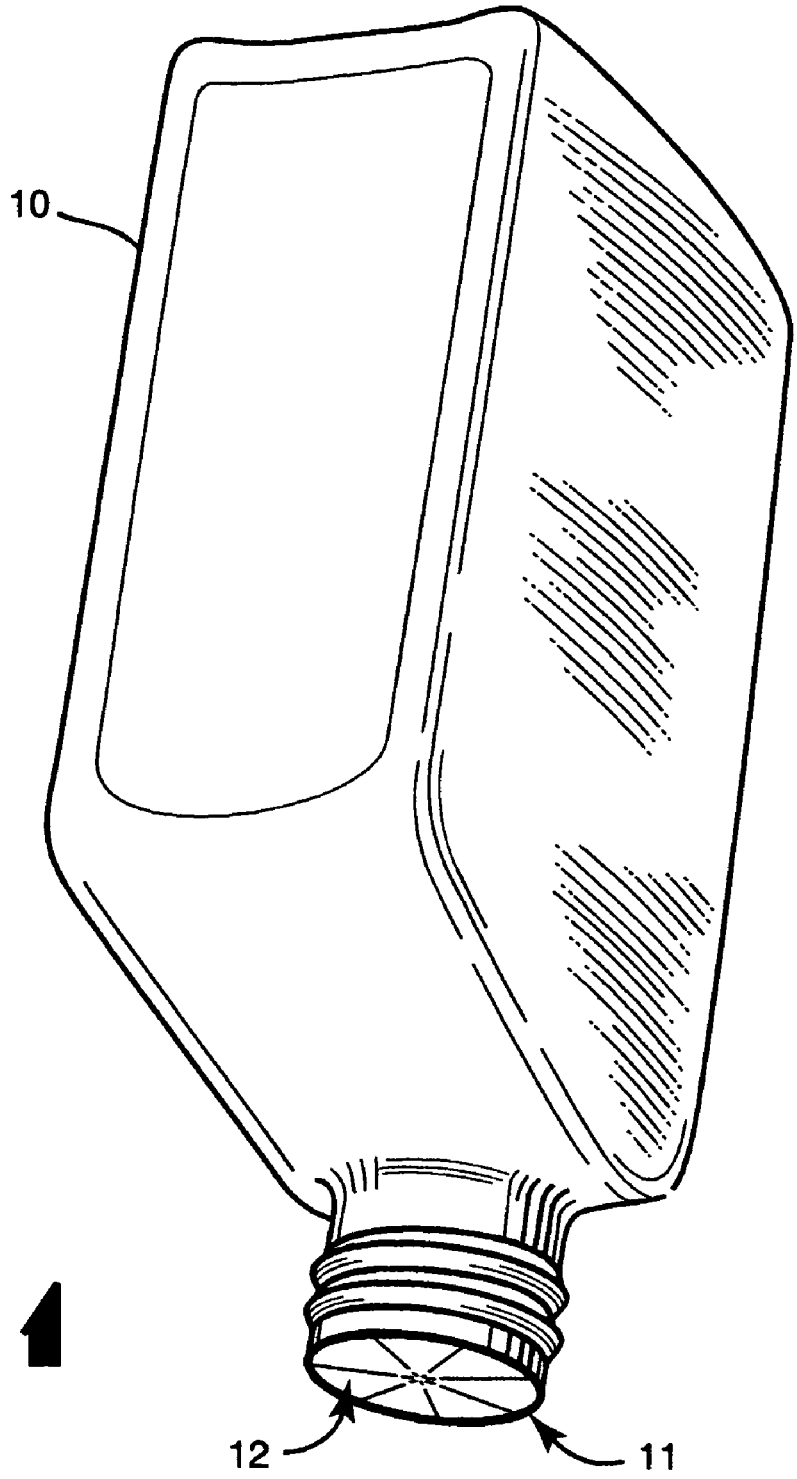
FIG. 1 is an overall view of a container in inverted position and including a closure according to the invention.

FIG. 1 shows a flexible container 10 that holds a pourable viscous fluid such as automotive motor oil. Container 10 is made of a flexible plastic material that has sufficient give that it deforms slightly when squeezed. Such containers are commonplace for use with motor oils and other substances. The container has a dispensing opening 11 through which the oil is poured, and the opening is covered by a closure 12 secured about the periphery of the opening. The container is shown in FIG. 1 in inverted position with the cap removed and ready for pouring the viscous contents. As the container is brought to its inverted position, closure 12 retains the viscous fluid in the container so that the fluid will not spurt or drip out. When the container is in position over the intended receptacle, the user gently squeezes the container causing closure 12 to rupture and allow the viscous fluid to flow. The closure disclosed herein provides for improved retention of the viscous fluid as the container is brought to its inverted position and improved pouring of the viscous fluid once the container is squeezed to rupture the closure.

Closure 12 is formed of a membrane that extends across the dispensing opening and provides the foundational member in which the various structures described below are formed. The membrane may have a compound composition including more than one layer—for example, a polymer layer permitting heat sealing to the periphery of dispensing opening 11 and a paper layer for structural integrity and possibly even a foil layer as a seal. Such membrane structures are well known in the art and need not be disclosed here in any detail.

Figure 2:
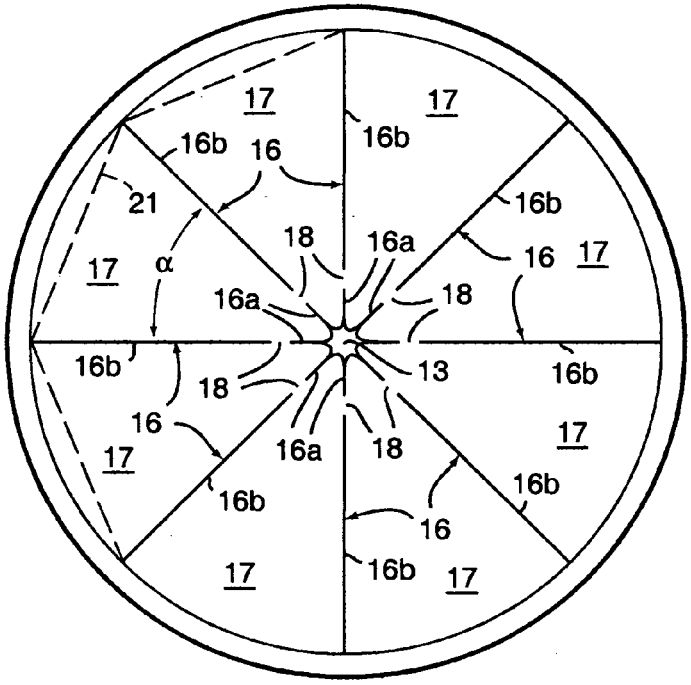
FIG. 2 is a plan view of a first embodiment of closure according to the invention.

The membrane has a small vent orifice 13, referred to here as the primary vent orifice, which is disposed in the region over the dispensing opening of the container. As shown in FIG. 2 vent orifice 13 is at the approximate center of the closure over the dispensing opening, however, in some embodiments it may be desirable the vent orifice to be offset from the center or more to one side of the dispensing opening. In particular, for dispensing openings having a more elliptical or ovaloid shape, it may be desirable to locate the vent orifice at a focus of the opening or even closer to the bottom of the intended pouring edge of the dispensing opening.

Emanating from primary vent orifice 13 and extending substantially to the periphery of the dispensing opening are a plurality of part lines 16, seen in FIG. 2. The part lines extend all the way into vent orifice 13; that is to say, they terminate in the orifice. The end of the part line at the primary vent orifice is referred to herein as the proximal end. To facilitate uniform rupture of the closure, the proximal ends are spaced about the primary vent orifice more or less uniformly although equal spacing is not necessary. In the embodiments illustrated here the part lines are straight. In other embodiments however the part lines could take other forms such as curved or some combination of curved and straight portions.

The part lines themselves comprise slits passing completely through the membrane. In general they may be formed by incisions made through the membrane although it is not intended to limit the invention to any particular method of fabricating the part lines. The part lines are so called because they form the lines along which the closure parts when the container is squeezed. That is to say, when the container is squeezed sufficiently to initiate pouring, the membrane ruptures along the part lines. Each pair of adjacent part lines defines a sector 17 of the membrane, which flaps open when the container 10 is squeezed.

The sectors 17 are held together to form the closure by a plurality of small connecting elements 18, one extending across each part line so as to hold neighboring sectors 17 together. The connecting elements 18 are located proximate to primary vent orifice 13 as may be seen in FIG. 2. Thus, each part line has two portions: a first short portion 16*a* extending from the primary vent orifice to a connecting element 18, and a second longer portion 16*b* extending from the same connecting element 18 substantially to the periphery. The small connecting elements interrupt what otherwise would be a continuous slit in the membrane.

Figure 4:
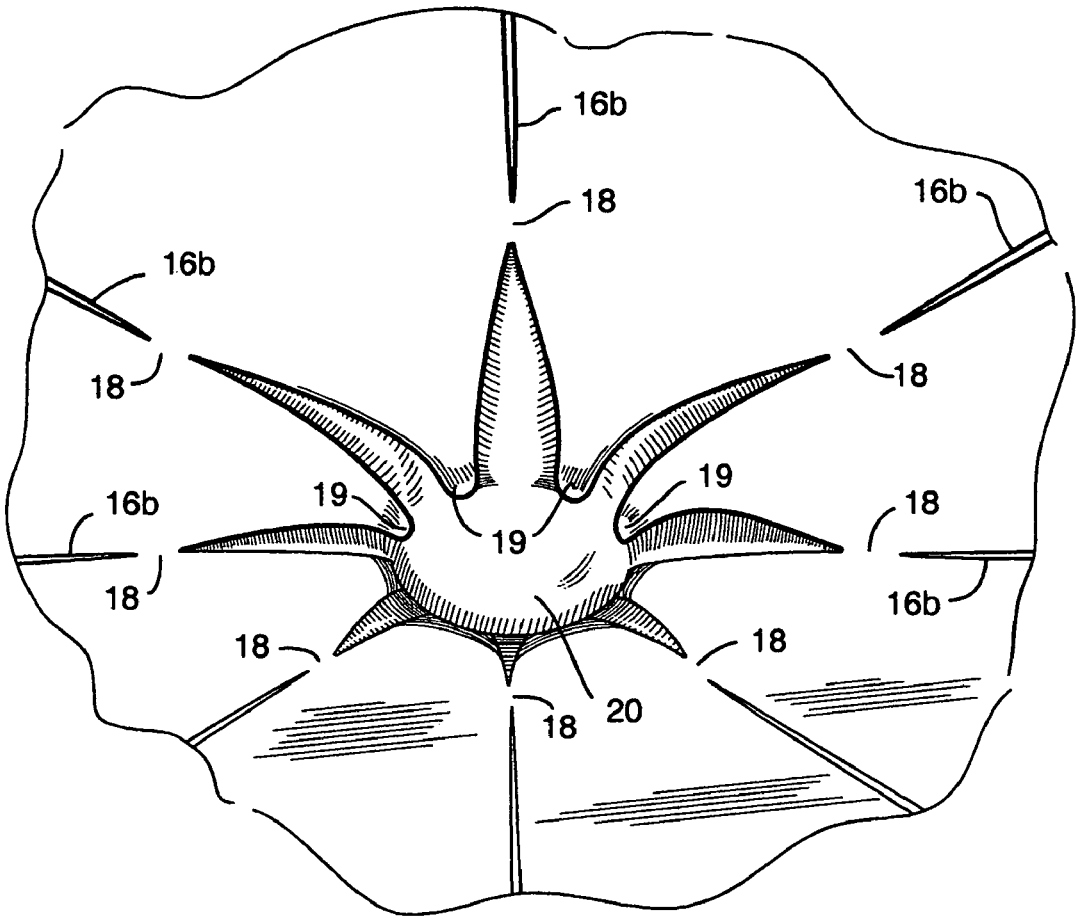
FIG. 4 is a close-up bottom perspective view showing the central portion of the closure of FIG. 2 as it starts to rupture.

When container 10 is squeezed, the force exerted on the membrane causes the connecting elements 18 to tear apart, thus enabling the sectors 17 to flap open under the action of the viscous fluid pouring out of the container. The tearing is initiated at the primary orifice 13 as the free tips 19 of the flaps bend outward under pressure by the squeezing of the flexible container. FIG. 4 shows a close-up view looking up at the peripheral area about the primary vent orifice as the rupture is initiated. An oil droplet 20 is seen pressing through the primary orifice and starting to bend up the tips 19. To facilitate the clean and immediate separation of tips 19 from one another under pressure, the tips may be formed with a generally rounded or scalloped shape such as shown in FIG. 4.

To achieve the desired effect, it is necessary that the size of the primary vent orifice, the size of the connecting elements, and the distance of the connecting elements from the primary vent orifice be coordinated. The precise relation depends on the size of the dispensing opening and on the viscosity of the viscous fluid the container is intended to hold, as well as to some extent the surface tension between the viscous fluid and the membrane. The area between the primary vent orifice and the connecting elements, referred to here as the peripheral area about the primary vent orifice, is essentially free to flap open along the short part lines portions 16*a*. The size of the primary vent orifice and the length of the short portions 16*a* is such that the fluid viscosity and surface tension prevent the fluid from passing through the peripheral area about the primary vent orifice when the container is in its inverted position. The fluid viscosity and surface tension also prevent the longer part line portions 16*b* from separating to let fluid through when the container is in its inverted position so long as connecting elements 18 remain unbroken. The connecting elements have sufficient width that the closure supports the weight of the fluid in the container when the container is inverted. Yet connecting elements 18 are sufficiently narrow that they will break under the pressure from squeezing the container. For any given container and viscous fluid contents it is well within the skill of the routine practitioner to determine appropriate sizes and spacings of the primary vent orifice and connecting elements empirically.

To provide a minimal opening for the viscous fluid to flow through, the closure must have at least three sectors 17 to flap open, that is, at least three part lines. A greater opening will be formed with a greater number of sectors. When the number of part lines, and the number of sectors, is equal to at least seven, there will be sufficient sectors for the ruptured closure to open to within at least about seven-eighths of the full area of the dispensing opening. Referring to FIG. 2, when a sector is forced open under the action of the fluid gushing out, it will tend to fold back along the fold line 21 indicated in several sectors in FIG. 2. The amount by which the closure opens may be measured by comparing the area of the dispensing opening with the area of the triangular section bounded by fold line 21 and the two adjacent part lines 16. The ratio of the two areas multiplied by 100 gives the percent by which the closure opens for a circular dispensing opening. The resulting percentage is given by the formula $$100 \cdot \frac{180}{\pi} \cdot \frac{\sin\alpha}{\alpha}$$

where the angle alpha ($\alpha$) is the angle of the sector at the primary vent orifice expressed in degrees. For seven sectors the area ratio is 87.1 percent; for eight sectors it is 90 percent. That is, with eight sectors and a circular dispensing opening the closure opens up to about 90 percent of the full area of the dispensing opening. For seven sectors it opens up to about 87 percent or about seven-eighths.

Figure 3:
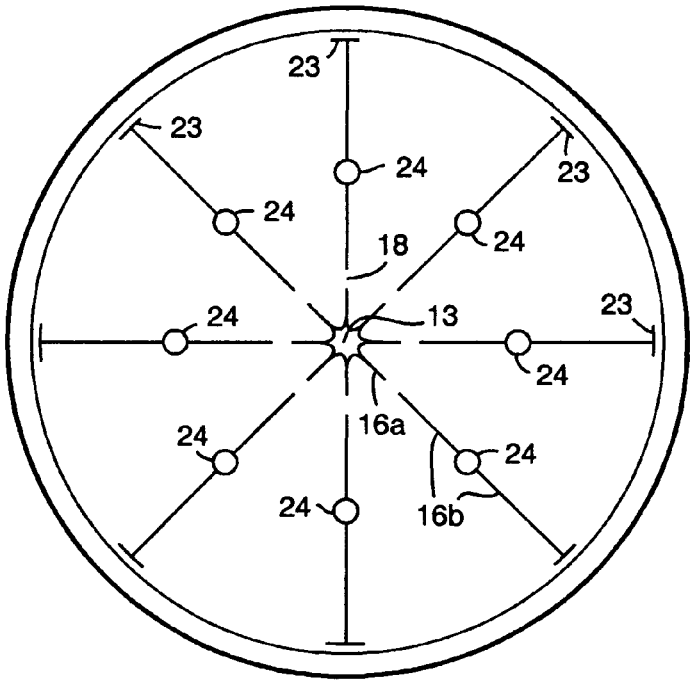
FIG. 3 is a plan view of a second embodiment of closure according to the invention.

To facilitate the opening of the closure even further, the closure may include auxiliary part lines 23, which extend transverse to the part lines 16*b* a short distance along the peripheral edge of the dispensing opening. The auxiliary part lines allow the sector to fold back even further under the action of the flowing viscous fluid. As illustrated in FIG. 3 each part line has an auxiliary part line extending into each neighboring sector. In other embodiments, however, the closure may be formed with fewer auxiliary part lines.

The primary vent orifice 13 serves two functions. First, it is the focus of the part lines, which all terminate at the primary vent orifice. The short part line portions 16*a* define small flaps about primary orifice. The flaps are held together by the connecting elements 18. The size of these flaps and of the primary orifice is such that the viscous fluid will not flow through the region within the ring of connecting elements 18 so long as the connecting elements remain intact due to the viscosity and surface tension of the viscous fluid. When the container is squeezed sufficiently to initiate pouring, the closure begins to open at the primary orifice under the generally uniform hydrostatic pressure from the fluid and the connecting elements break away allowing the closure to open all the way. In this manner the closure begins to open in a controlled location generally within the central regions of the dispensing opening and proceeds smoothly from there.

Another function served by the primary vent orifice is to allow the closure to breathe, that is, to allow an amount of air to pass through. This breathing action serves to relieve the pressure that results when the user grasps the container and removes the cap. Simply by gripping the container, the user will necessarily have to squeeze the container somewhat, which in turn causes pressure to be exerted on the closure. The vent function of the orifice serves to relieve this pressure and prevent premature opening or rupture of the closure. In addition, the orifice allows the closure to breath as the container is inverted and the viscous fluid shifts within the container. To facilitate the breathing function, the closure may be provided with one or more auxiliary vent orifices 24 to increase influx and outflow of air. The auxiliary orifices, like primary orifice 13, are sized so that the viscous fluid will be prevented from flowing through the orifices by the viscosity and surface tension of the fluid with the membrane material, so long as the closure remains unruptured. While the auxiliary orifices may be located at any position in the region beyond the connecting elements, they may also facilitate smoother opening of the closure if they are located on the part lines as shown in FIG. 3.

The above descriptions and drawings are given to illustrate and provide examples of various aspects of the invention in various embodiments. It is not intended to limit the invention only to these examples and illustrations. For example, in some embodiments the closure may include other layers not interfering with the primary orifice, connecting elements or part lines. For example, in some embodiments it may be desirable to include a foil layer covering a portion of the membrane to help in sealing the membrane. A sufficiently thin foil layer may not need to be pre-slit over the part lines and may in fact cover at least the outer portion of the part lines. If the primary vent orifice and the immediate vicinity of the primary orifice are left uncovered and free to breathe, the foil in such embodiments will not impede significantly the breathing function of the membrane and the rupture will still be initiated at the primary orifice. A sufficiently thin foil, even if not pre-slit, can still tear away under the action of the outflow of oil from the peripheral area about the primary orifice and the outbending of the sectors 17 when the container is squeezed sufficiently to initiate rupture.

Thus, given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims.

What is claimed is:

1. A closure for use in combination with a flexible container for a pourable viscous fluid, the container having a dispensing opening for pouring the fluid from the container and the closure being secured to the periphery of the dispensing opening so as to cover the opening, characterized in that:

said closure comprises a membrane having a primary vent orifice in the region over said dispensing opening and a plurality of at least three part lines through said membrane, said primary vent orifice being sized to permit said membrane to breathe;

said part lines having proximal ends spaced about, and terminating in, said primary vent orifice, and said part lines extending outward from said vent orifice substantially to said periphery;

each said part line being interrupted by a small connecting element extending thereacross proximate to said primary vent orifice; and wherein said primary vent orifice and said connecting elements have sufficiently small size, and said connecting elements are positioned sufficiently close to said primary vent orifice, that said membrane will contain said viscous fluid within said container when said container is brought into inverted position for pouring, yet said connecting elements will break away and said membrane will separate along said part lines when said flexible container is squeezed, thereby enabling said viscous fluid to flow through said dispensing opening.

2. The closure of claim 1 wherein the proximal ends of said part lines are arranged generally uniformly about said vent orifice.

3. The closure of claim 2 wherein said connecting elements are equally spaced from said vent orifice.

4. The closure of claim 1 comprising at least seven part lines defining at least seven approximately equal sections of said membrane.

5. The closure of claim 1 wherein the dispensing opening is generally circular, said vent orifice is disposed proximate the center of said generally circular opening, and said part lines are generally linear and extend radially outward from said primary vent orifice.

6. The closure of claim 5 wherein said connecting elements form a generally circular pattern about said vent orifice.

7. The closure of claim 1 further comprising a plurality of auxiliary vent orifices in said membrane.

8. The closure of claim 7 wherein at least some of said auxiliary vent orifices are disposed at at least some of said part lines.

9. The closure of claim 8 wherein an auxiliary vent orifice is disposed at each part line.

10. The closure of claim 1, further comprising a plurality of part line extensions extending along portions of said periphery and connecting to at least some of said part lines.

11. A closure for use in combination with a flexible container for a pourable viscous fluid, the container having a dispensing opening for pouring the fluid from the container and the closure being secured to the periphery of the dispensing opening so as to cover the opening, characterized in that:

said closure comprises a membrane having a primary vent orifice disposed in a generally central region over said dispensing opening and at least seven part lines through said membrane, said primary vent orifice being sized to permit said membrane to breathe;

said part lines having proximal ends spaced about, and terminating in, said primary vent orifice, said proximal ends being spaced generally uniformly about said primary vent orifice and said part lines extending generally radially outward from said vent orifice substantially to said periphery;

each said part line being interrupted by a small connecting element extending thereacross proximate to said primary vent orifice; and wherein said primary vent orifice and said connecting elements have sufficiently small size, and said connecting elements are positioned sufficiently close to said primary vent orifice, that said membrane will contain said viscous fluid within said container when said container is brought into inverted position for pouring, yet said connecting elements will break away and said membrane will separate along said part lines when said flexible container is squeezed, thereby enabling said viscous fluid to flow through said dispensing opening.

* * * * *